US007294032B1

(12) United States Patent
Ventura

(10) Patent No.: US 7,294,032 B1
(45) Date of Patent: Nov. 13, 2007

(54) DEVICES AND METHODS FOR SECURING WATER SPORT BOARDS

(76) Inventor: Mark Ventura, 15721 Willett Way, Huntington Beach, CA (US) 92647

( * ) Notice: Subject to any disclaimer, the term of this patent is extended or adjusted under 35 U.S.C. 154(b) by 0 days.

(21) Appl. No.: 11/201,758

(22) Filed: Aug. 10, 2005

Related U.S. Application Data

(60) Provisional application No. 60/600,554, filed on Aug. 10, 2004.

(51) Int. Cl.
*B63B 1/00* (2006.01)
*E05B 69/00* (2006.01)

(52) U.S. Cl. ..... 441/75; 70/58

(58) Field of Classification Search ..... 441/74, 441/75; 70/58, 18
See application file for complete search history.

(56) References Cited

U.S. PATENT DOCUMENTS

| | | | | |
|---|---|---|---|---|
| 4,820,220 | A * | 4/1989 | Fruzzetti et al. | 441/74 |
| 6,688,145 | B2 * | 2/2004 | Tan | 70/58 |
| 6,691,537 | B2 * | 2/2004 | Tan | 70/58 |
| 6,763,689 | B1 * | 7/2004 | Thomas | 70/14 |

* cited by examiner

*Primary Examiner*—Jesús D. Sotelo
(74) *Attorney, Agent, or Firm*—Robert D. Buyan; Stout, Uxa, Buyan & Mulins, LLP

(57) ABSTRACT

A water sport board locking system includes multiple key members that are insertable into a slot of a fin box of a water sport board (e.g., a surf board, for example a surfboard. The key members include a key member that operates as a rotation deterrent element which prevents rotation of another key member when the key members are located in the fin box slot and secured together with a tether or padlock. The system can be used to secure a water sport board while a fin of the watersport board remains located in the fin box slot.

18 Claims, 4 Drawing Sheets

DEVICES AND METHODS FOR SECURING WATER SPORT BOARDS

RELATED APPLICATION

This application claims the benefit of U.S. Provisional Pat. App. No. 60/600,554, filed on Aug. 10, 2004, the entire disclosure of which is incorporated herein by this specific reference.

BACKGROUND

The present invention relates generally to surfboard devices and, more specifically, to a security locking device for a surfboard, sailboard, kayak and the like.

The streamlined shape and relatively small size of many modern surfboards make them easy and inviting targets for theft. A typical surfboard can cost from $400 to a $1,000 so replacement of a stolen board is not always economically feasible. In addition, a surfboard has a size and shape that makes it not easily adapted to being fitted with a conventional locking device or being secured within an automobile when not in use.

Consequently, a number of locking devices have been developed to prevent the theft of surfboards. The Fruzetti et. al. patent (U.S. Pat. No. 4,820,220) employs the ankle tether commonly found on surfboards to secure the board to a stationary object. However, the ankle tether is typically a lightweight material such as nylon that can be easily severed with common wire cutters.

Other surfboard locks that have been developed require some mechanical connection with the cross bar that is typically built into a surfboard and intended to provide a point of connection between the surfboard and the ankle tether. Still other devices have been developed that utilize a fin box of a surfboard as an anchor point for a locking mechanism. Though effective to some extent against opportunistic theft, these prior art devices are often defeatable by thieves that have sufficient time and/or skill to effectively manipulate the device. In addition, such devices are often cumbersome to install and so are not always properly utilized.

There still exists a need for methods and devices for securing and/or deterring theft of water sport boards, for example, surfboards, sailboards, body boards, boogie boards and the like, which methods and devices are easy to use not easily circumvented.

SUMMARY OF THE INVENTION

The present invention provides a locking method and system for tethering, securing or locking a water sport board to a vehicle or stationary object thereby deterring theft or unauthorized removal of the water sport board. Water sport boards that are useful with the present invention are generally those water sport boards that comprise a body, such as a buoyant platform, having a built-in fin box, for example, but not limited to surfboards, sailboards, kayaks, body boards, boogie boards, paddle boards, or similar devices.

In accordance with the present invention, there is provided a system for deterring theft or unwanted movement of a water sport board (e.g., a surfboard, sailboard, kayak, body board, boogie board, paddle board, or similar device) of a type having a built-in fin box. This system generally comprises a) a key member or element that is configured to enter and engage a slot of the fin box, said key member being additionally configured to be attached to a fastening member, for example, a theft deterring tether, padlocked cable, chain, etc., and b) second key member, for example, a rotation deterring member or element that is configured to substantially prevent the key member from rotating in a manner that allows the key member to be disengaged and removed from the slot. In some embodiments, the rotation deterring member may comprise one or more additional key member(s) that are received within the same slot as the first key member so as to substantially fill an open area within that slot thereby substantially preventing at least the first key member from rotating within the slot. The rotation deterring member (e.g., additional key member(s)) may be engaged, locked or connected to the first key member and/or to one another. In at least some embodiments, the systems of the present invention may not require removal of a fin from a fin box in order to be useful as is true of some prior art devices that utilize a fin box as an anchor for a locking mechanism but require removal of a fin in order to work.

In accordance with some embodiments of the invention, the first key member, second key member and fastening member are configured so as to be easily manipulable to enable a user of the system to position the first key member and the second key member in the fin box slot such that the key members are received in first and second recesses within the fin box slot. When the key members are engaged to the fin box in this manner and are secured together, for example, using a fastening member or mechanism through apertures formed in the key members, the coupled system and water-sport board can be locked to an object.

Further in accordance with the present invention, there is provided a method for deterring theft or unauthorized movement of a water sport board that includes a fin box having a slot with first and second recesses formed therein. Such method comprises the steps of a) providing a system that comprises a first member and a second member, the first member and second member being configured to enter and be engaged in the slot of the fin box; b) inserting a portion of the first member into the slot such that it resides in the first recess; c) inserting a portion of the second member into the slot such that it resides in the second recess; d) moving the first member and second member into engagement with one another; e) fastening the first member and the second member together and f) securing the fastened first member and the second member to an object.

Still further in accordance with the invention, there are provided embodiments of the above-summarized system which comprise a first key member that includes a protrusion configured to engage a first recess in the fin box slot, and a second key member which functions as the rotation deterring member. In such embodiments, the second key member includes a structure or surface that is configured to engage the first key member so as to prevent substantial rotation of the first and/or second key members when the first and second key members are in a locked position, for example when the first and second key members are engaged to the fin box slot and are bound or locked to one another, for example, by means of a padlock. In at least some embodiments, at least one of the first and the second key members is structured to be received within a second recess of the fin box slot, wherein the second recess is a recess substantially opposing the first recess.

Each and every feature described herein, and each and every combination of two or more such features is included within the scope of the invention provided that the features included in such combination are not mutually inconsistent.

BRIEF DESCRIPTION OF THE DRAWINGS

The present invention may be more clearly understood with reference to the following Detailed Description and accompanying Drawings, which describe and show specific embodiments of the present invention but are not intended to limit the scope thereof.

FIG. 2A' is a top view of the embodiment of the invention shown in FIG. 2A.

FIG. 3A' is a top view of the embodiment of the invention shown in FIG. 3A.

DETAILED DESCRIPTION

Figure 1:
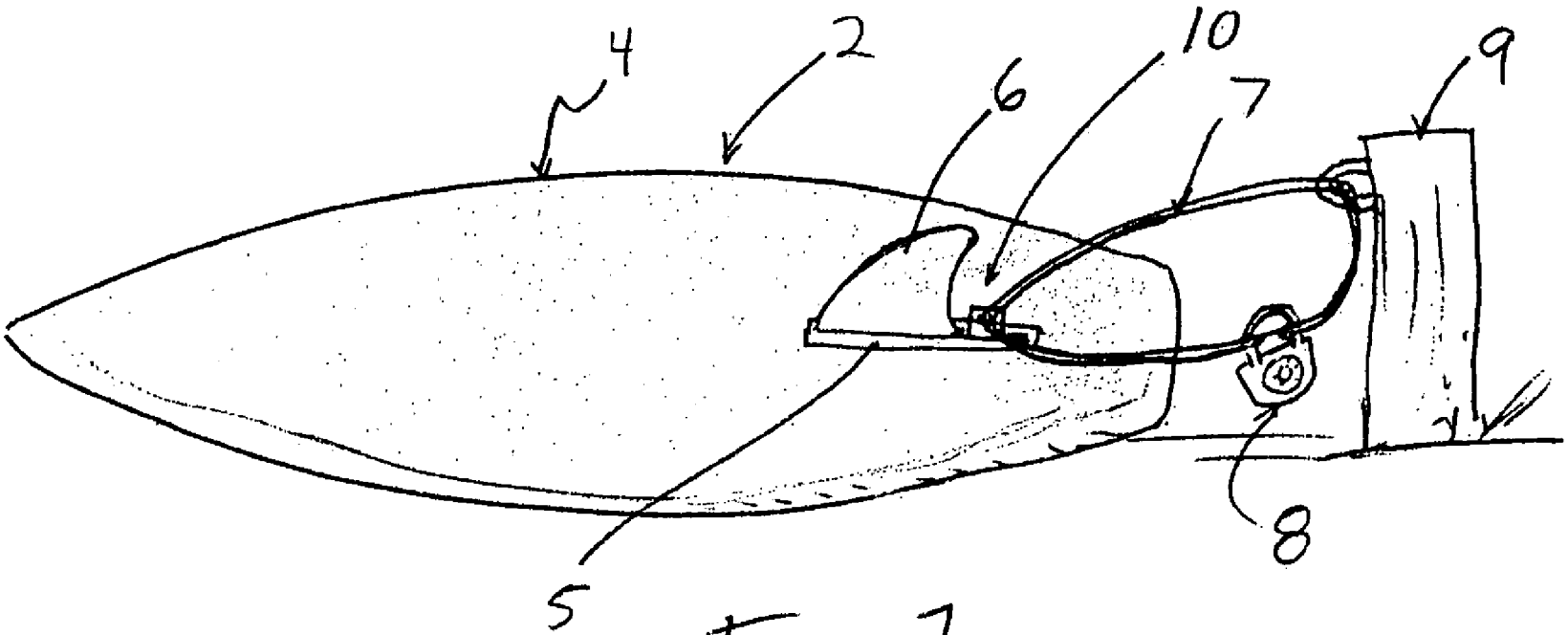
FIG. 1 shows a perspective view of a surfboard lock system as the system is being used to prevent theft or unauthorized removal of a surfboard.

Turning now to FIG. 1, a system 10 in accordance with an embodiment of the invention is shown as it is being used to deter theft of a water sport board 2 comprising a buoyant platform 4, a fin box 5 and a fin 6. In this particular example, the water sport board 2 used with the system 10 is a conventional surfboard. It should be appreciated, however, that the system 10 of the present invention is structured to be useful for deterring theft of other types of water sport boards which generally include a buoyant platform, a fin box and a fin. The water sport board may be, for example, a surfboard, sailboard, kayak, body board, boogie board, paddle board, or similar device. As shown in FIG. 1, the system 10 is being used in conjunction with a theft deterrent tether 7, a padlock 8 and an immovable post 9.

Figure 1A:
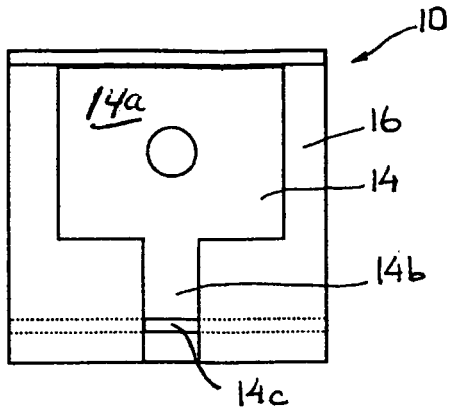
FIG. 1A shows a plan view of a surfboard lock system of an embodiment of the invention.
Figure 1B:
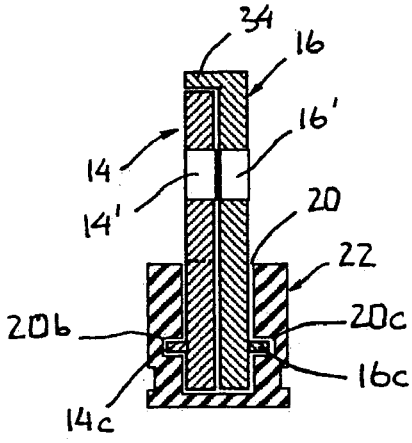
FIG. 1B shows a cross-sectional view of the system shown in FIG. 1A as the system is engaged to a fin box of a surfboard.

Referring now to FIG. 1A, the system 10 generally comprises a first key member 14 and a second key member 16. Turning as well to FIG. 1B, a cross sectional view of the system 10 in accordance with the present invention as it is engaged to fin box 5 is shown. The first and second key members 14, 16 respectively, are configured and structured to engage a slot 20 of a fin box 5 (shown in cross section).

More particularly, the first key member 14 includes a head portion 14*a*, a pin portion 14*b*, and a protrusion 14*c* (more clearly shown in FIG. 1B) that is sized and configured to engage a recess 20*b* within a fin box slot 20. Second key member 16 may also include a protrusion 16*c*. The protrusion 16*c* is located, sized and configured to engage an opposing recess 20*c* of the slot 20.

Referring now to FIG. 1B, each key member 14 and 16 includes at least one aperture 14' and 16' respectively, for receiving a shank of a padlock 30, a chain, tether, cable or other security element (see FIG. 1C) such that the system 10 and surfboard can be bound to a fence, post, truck bed, bicycle rack or other fixed structure. When the system 10 is properly arranged in a fin box slot 20 as shown, the apertures 14' and 16' of key member 14 and key member 16 are in substantial alignment with one another.

First key member 14 and second key member 16 may be made of stainless steel, aluminum, or any other suitable material. In some embodiments, the members 14, 16 have a solid metal construction. As shown, the key members 14 and 16 are substantially planar in structure and are configured to align with the longitudinal axis of the fin box slot 20 when engaged thereto.

Figure 1C:
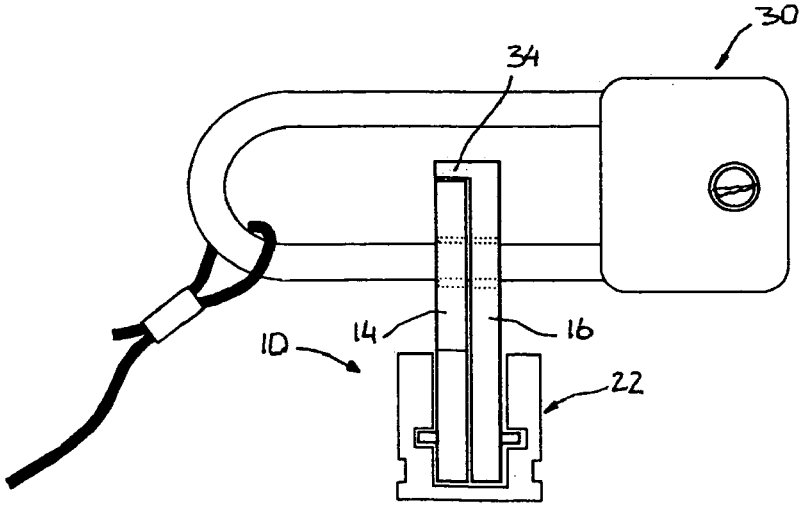
FIG. 1C shows a side view of the system shown in FIG. 1A as the system is engaged to a fin box of a surfboard and is secured to a padlock and tether.

In order to install the system 10 to a surfboard, second key member 16 is manually inserted into an exposed portion of a fin box slot 20, for example a portion of the fin box slot 20 that is not covered by the surfboard fin 6 (shown in FIG. 1) and protrusion 16*c* is pushed into engagement with the slot recess therein. Next, key member 14 is placed into the slot 20 such that it engages the substantially opposing recess 20 and slid along the slot 20 until apertures 14' and 16' are in alignment with one another. In this particular embodiment, key member 16 includes structure, for example flange portion 34 that engages upper edge of key member 14 as shown, and prevents substantial rotation of either of the key members 14 and 16 when the system is installed to a fin box 22 as shown in FIG. 1C.

Figure 2A:
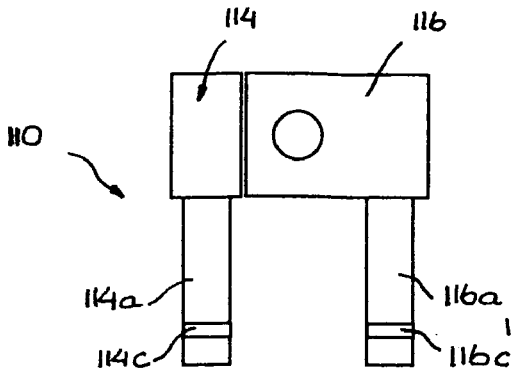
FIG. 2A is a side view of another embodiment of the invention.
Figure 2A:
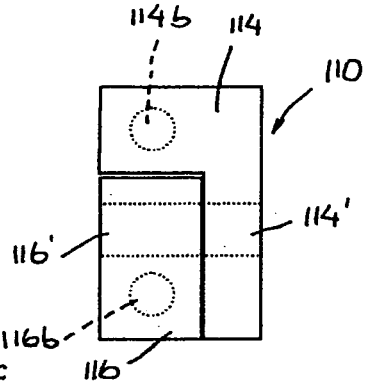
Figure 2B:
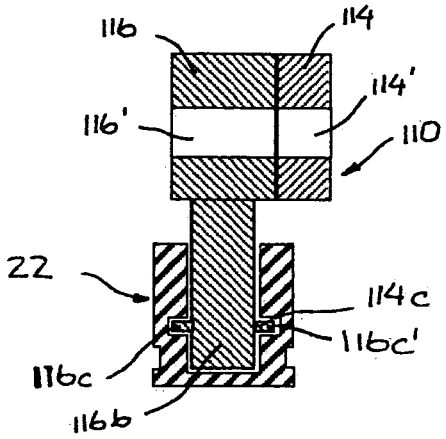
FIG. 2B is a cross sectional view of the embodiment of the invention shown in FIG. 2A as the system is engaged to a fin box of a surfboard
Figure 2C:
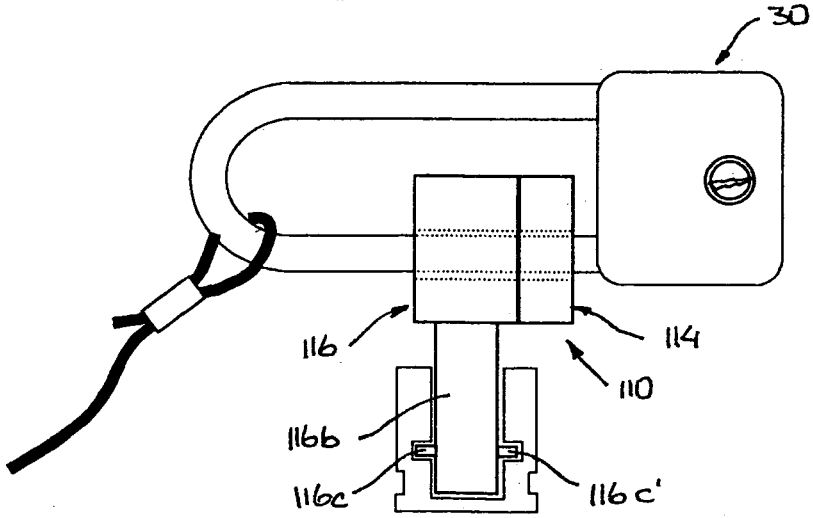
FIG. 2C is a front view of the embodiment of the invention shown in FIG. 2A as the system is engaged to a finbox and secured to a padlock and tether.

Another system 110 in accordance with an alternative embodiment of the present invention is shown in FIGS. 2A–2C. FIG. 2A shows a side view of system 110. FIG. 2A' shows a top view of system 110. FIG. 2B shows a cross sectional view of system 110 as it is engaged to a fin box 22. FIG. 2C shows a view of system 110 similar to the view shown in FIG. 2*b*, with the addition of a padlock 30 received through the system 110.

The system 110 generally includes a first key member 114 and a separate, second key member 116 each having body portions 114*a* and 116*a*, respectively, and legs 114*b* and 116*b*, respectively. When arranged in a fin box slot 20, leg portions 114*b* and 116*b* are spaced apart along a longitudinal axis of the fin box 22. Like system 10, system 110, when in use, has aligned apertures 114' and 116' as shown.

Turning now to FIGS. 2B and 2C, each of legs 114*b* and 116*b* includes opposing protrusions 114*c* and 116*c* located, sized and structured to engage opposing slot recesses 20*b* and 20*c*. For example, as shown in FIG. 2*b*, leg 116*b* includes a protrusion 116*c* and an opposing protrusion 116*c*'. Leg 116*b* is sized and structured to closely conform within fin box slot 20.

When system 110 is properly installed to a fin box 22, such as shown in FIG. 2C, and a fin (not shown) is installed in another portion of the fin box slot 20, the relatively wide spacing of legs 114*b* and 116*b* substantially prevents the system 110 from being removed from a fin box 22, for example, by manual attempts to pivot or rotate the system 110 out from the fin box slot 20, for example in a longitudinal direction.

Figure 3A:
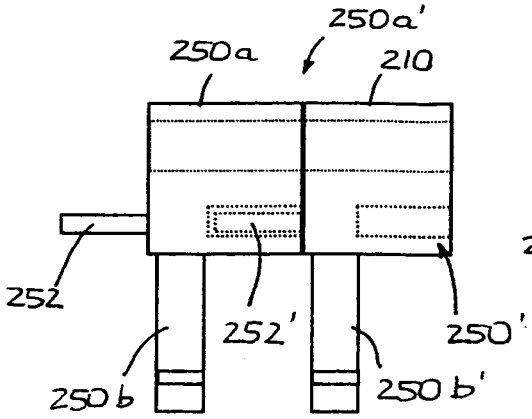
FIG. 3A is a side view of another embodiment of the invention.
Figure 3A:
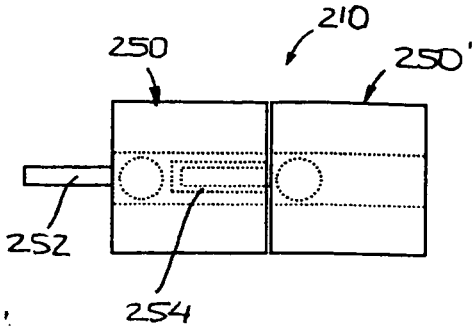
Figure 3B:
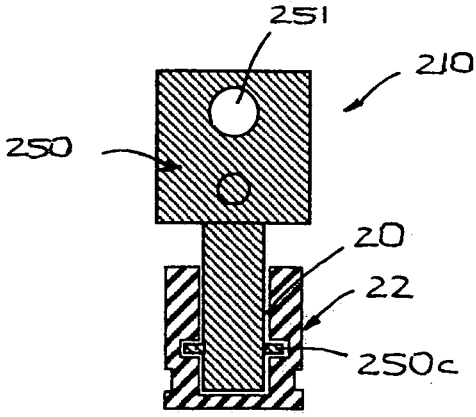
FIG. 3B is a cross sectional view of the embodiment of the invention shown in FIG. 3A as the system is engaged to a fin box of a surfboard
Figure 3C:
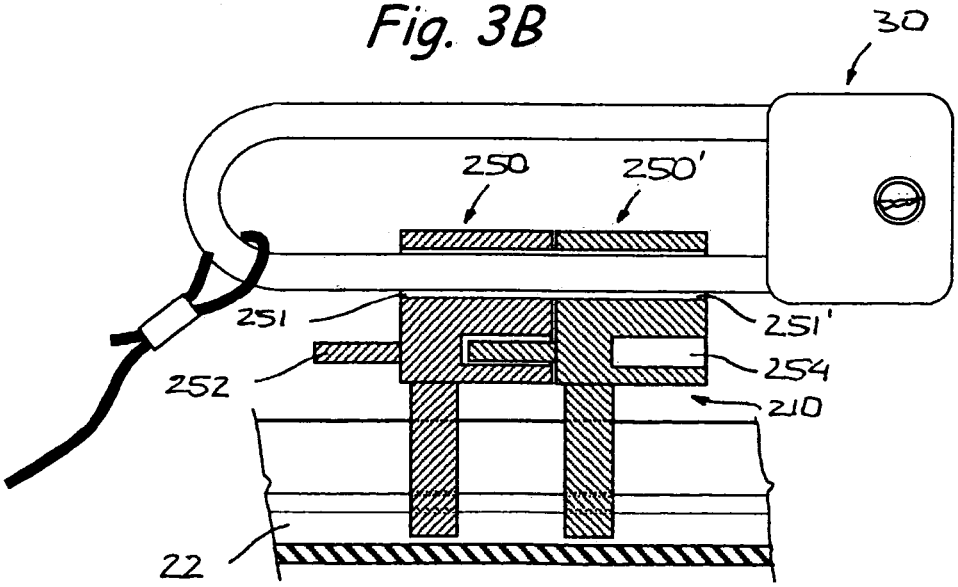
FIG. 3C is a cross-sectional view of the embodiment of the invention shown in FIG. 3A as the system is engaged to a finbox and secured to a padlock and tether.

Turning now to FIGS. 3A–3C, another system 210 in accordance with the present invention is shown. Unlike systems 10 and 110, system 210 includes identical, or substantially identical, key members 250 and 250'. Each key member 250 (250') includes a head portion 250*a* (250*a*') and a pin portion 250*b* (250*b*') structured to engage a fin box slot 20. For example, each pin portion 250*b* (250*b*') includes opposing protrusions 250*c* (250*c*').

As shown in FIGS. 3A and 3A', each of identical key members 250 is structured, sized and/or otherwise configured to engage another of said key members 250', for example by means of aperture 252 and pin 254. This embodiment of the present invention is shown most clearly in FIG. 3C, which provides a cross sectional view of system 210 engaged to a fin box 22 and having a padlock 30 connected to both members 250 and 250' by means of aligning apertures 251 and 251'.

One or more of the systems of the invention may be designed such that upon securement of the system to the fin box as described elsewhere herein, at least one of the key members, for example, due to size or shape thereof, will overlap or obstruct access to a screw or other fastener that secures the fin box to the board, thereby preventing or at least deterring theft of the board by removal of the fin box itself. This is possible in part because of the design of embodiments of the system which prevents any substantial rotation of the key members when they have been secured to the fin box in accordance with the invention.

The present invention also provides methods for deterring theft or unauthorized removal of a water sport board, for example, using one of the systems of the invention as described elsewhere herein.

A method of the invention for deterring theft may comprise the steps of providing a system including a first member and a second member wherein the members are configured to enter and be engaged in a slot of a built-in fin box of a water sport board. In accordance with a method of the invention, the first member is manually inserted into the fin box slot such that a portion of the first member enters and resides within a longitudinal recess in the slot. The second member is similarly placed into the slot such that a portion of the second member resides within a substantially opposing recess in the slot. The method further comprises the step of moving the first member and second member into contact or engagement with one another so as to cause an aperture of the first member to become aligned with an aperture of the second member. The first member and second member are now located in the slot in a manner such that a cross-sectional region of the slot is substantially filled with the members. The first member and second member are fastened to one another, for example, by inserting a tether, padlock or combination thereof, through the aligned apertures. The fastened first member and the second member are now restricted from rotating any substantial degree. The fastened members can then be secured or locked to an object, for example a truck bed, bicycle rack, tree, post, etc., in order to deter theft or prevent unauthorized removal of the water sport board therefrom.

It is to be appreciated that the invention has been described hereabove with reference to certain examples or embodiments of the invention but that various additions, deletions, alterations and modifications may be made to these examples and embodiments without departing from the intended spirit and scope of the invention. For example, any element or attribute of one embodiment or example may be incorporated into or used with another embodiment or example, unless to do so would render the embodiment or example unsuitable for its intended use. Also, for example, where the steps of a particular method are described in a certain order, the steps may be performed in any other order unless specified otherwise or unless changing the order of the steps would render the method ineffective or unsuitable for its intended purpose. All reasonable additions, deletions, modifications and alterations are to be considered equivalents of the described examples and embodiments and are to be included within the scope of the following claims.

What is claimed is:

1. A system useful for deterring theft or unauthorized removal of a water sport board having a buoyant platform and a built-in fin box, said system comprising:

A) a first key member configured to enter and be engaged in a slot of a fin box of a water sport board, said first key member being additionally configured to be secured to a padlock or a tether; and B) a rotation deterring member having a protrusion that extends in a first direction and a flange that extends in a second direction substantially opposing the first direction, said rotation deterring member being configured to substantially prevent the key member from being rotated sufficiently to enable disengagement of the key member from the slot when the key member is engaged in the slot and the rotation deterring member is secured to the key member.

2. A system according to claim 1 wherein the rotation deterring member comprises a second key member configured to reside within the slot in a manner that substantially prevents the first key member from being removed from the slot.

3. A system according to claim 1 wherein the rotation deterring member is engageable with the first key member.

4. A system according to claim 1 further comprising a mechanism suitable to secure the first key member with the rotation deterrent member when the first key member is engaged in the slot.

5. A system according to claim 1 wherein the first key member and the rotation deterring member are configured such that the system is usable to deter theft or unauthorized removal of the water sport board without requiring removal of a fin from the slot.

6. A system according to claim 1 wherein the first key member includes a protrusion configured to enter and become engaged within a first longitudinal recess of the slot when the first key member is inserted into the slot.

7. A system according to claim 6 wherein the rotation deterring member includes a protrusion configured to enter and become engaged within a second longitudinal recess substantially opposing the first longitudinal recess when the rotation deterring member is inserted into the slot.

8. A method for deterring theft or unauthorized movement of a water sport board that includes a fin box having a slot with first and second recesses formed therein, said method comprising:

providing a system that comprises a first member and a second member, the first member and second member being configured to enter and be engaged in the slot of the fin box;

inserting a portion of the first member into the slot such that it resides in the first recess;

inserting a portion of the second member into the slot such that it resides in the second recess;

moving the first member and second member into engagement with one another;

fastening the first member and the second member together;

securing the fastened first member and the second member to an object;

wherein the first member includes a protrusion configured to be received in the first recess and the second member includes a protrusion configured to be received in the second recess.

9. A method for deterring theft or unauthorized movement of a water sport board that includes a fin box having a slot with first and second recesses formed therein, said method comprising:

providing a system that comprises a first member and a second member, the first member and second member being configured to enter and be engaged in the slot of the fin box;

inserting a portion of the first member into the slot such that it resides in the first recess;

inserting a portion of the second member into the slot such that it resides in the second recess;

moving the first member and second member into engagement with one another;

fastening the first member and the second member together;

securing the fastened first member and the second member to an object;

wherein the second member includes a protrusion configured to be received in the substantially opposing recess and a flange configured to engage an edge of the first member.

10. A method according to either of claims 8 or 9 wherein the step of moving the first member and second member into engagement with one another comprises sliding one of the first and second member along a portion of the slot.

11. A method according to either of claims 8 or 9 which is performed while a fin of the water sport board is located in the fin box.

12. A method according to either of claims 8 or 9 wherein the step of fastening the first member and the second member together substantially prevents the first member from being rotated sufficiently to enable disengagement of the first member from the slot.

13. A method according to either of claims 8 or 9 wherein the step of fastening the first member and the second member together substantially prevents the first and second members from being rotated sufficiently to enable disengagement of the members from the slot.

14. A method according to either of claims 8 or 9 wherein apertures are formed in the first member and second member.

15. A method according to claim 14 wherein the step of fastening the first member and the second member together comprises inserting a fastening member through the apertures.

16. A method according to claim 15 wherein the fastening member comprises a tether.

17. A method according to claim 15 wherein the fastening member comprises a padlock and the shank of the padlock is passed through the apertures.

18. A system useful for deterring theft or unauthorized removal of a water sport board having a buoyant platform and a built-in fin box, said system comprising:

a first key member, including a distal portion having a protrusion, and configured so as to enable engagement thereof with a fin box of a water sport board by insertion of the distal portion into a slot of the fin box such that the protrusion enters a first recess in the slot; and a second key member including a distal portion having a protrusion, and configured so as to enable engagement thereof with a fin box of a water sport board by insertion of the distal portion into a slot of the fin box such that the protrusion enters a second recess in the slot substantially opposing the first recess;

a fastening member suitable to secure the first key member to the second key member;

the first key member, second key member and fastening member being manually manipulable to enable a user of the system to position the first key member and the second key member in the slot such that the protrusions are received in the recesses, and to secure the key members together with the fastening member, so as to prevent removal of the system from the fin box without unlocking or disconnecting the fastening member.

* * * * *